United States Patent [19]

Schiel

[11] 4,285,768

[45] Aug. 25, 1981

[54] APPARATUS FOR DEWATERING FIBER SUSPENSION FOR PRODUCING A WEB OF FIBER

[75] Inventor: Christian Schiel, Heidenheim, Fed. Rep. of Germany

[73] Assignee: J. M. Voith GmbH, Fed. Rep. of Germany

[21] Appl. No.: 46,661

[22] Filed: Jun. 8, 1979

[30] Foreign Application Priority Data

Jun. 15, 1978 [DE] Fed. Rep. of Germany ..... 2826158

[51] Int. Cl.[3] ..... D21F 9/00

[52] U.S. Cl. ..... 162/301; 162/203

[58] Field of Search ..... 162/301, 203, 350

[56] References Cited

U.S. PATENT DOCUMENTS

| | | | |
|---|---|---|---|
| 3,236,724 | 2/1966 | Wallstrom | 162/203 |
| 3,746,613 | 7/1973 | Vaulkonen | 162/203 |
| 3,992,253 | 11/1976 | Schiel | 162/301 |

*Primary Examiner*—William F. Smith

*Attorney, Agent, or Firm*—Ostrolenk, Faber, Gerb & Soffen

[57] ABSTRACT

The invention relates to apparatus for the production of a web of fiber by dewatering a suspension of fibrous material between a pair of rotating strips, at least one of which is water permeable, wherein the suspension follows a curved path between the strips. The invention seeks to avoid or at least reduce undesirable pressure gradients along the flow path of the suspension by controlling the radius of curvature of at least one of the strips according to a formula.

10 Claims, 5 Drawing Figures

APPARATUS FOR DEWATERING FIBER SUSPENSION FOR PRODUCING A WEB OF FIBER

BACKGROUND OF THE INVENTION

The invention concerns apparatus for the production of a web of fiber, e.g. a paper web, by dewatering a liquid suspension of the fibrous material between a first or inner rotating strip that is directed over a convexly curved supporting device and a second or outer rotating strip which is curved concavely over the suspension and which is held under tension longitudinally. The two strips rotate or move together through the dewatering area and carry the suspension between them. At least one of the strips is water permeable. This apparatus would typically be used in a paper making machine.

The permeable one of the two strips is usually like a sieve. When it is in the form of a metallic screen, the permeable strip is called a wire. The other strip may also be water permeable, e.g. it may be a wire or it may be a fabric screen, called a felt. Apparatus such as these when used in paper making machines are familiarly known as twin wire formers, crescent formers, etc.

These apparatus as opposed to the usual long wire apparatus, have the advantage that dewatering of the suspension can occur from both sides simultaneously and there is no free surface or unpressured portion of the suspension during the formation of the web. By providing an area for the formation of the web which has a constantly decreasing radius, it is sought to reduce the length of the dewatering area of the apparatus. (See German Published Specification Offenlegungsschrift 2,059,962). Also, it is sought to avoid accumulation of water and the consequent relatively limited flows at the intake or the entrance to the dewatering area as well as uncontrollable shearing flows in the area of drainage, at an angle to the strips. (Journal "Das Papier", 31. Year of Publication, Volume 10A (1977), Pages V 125 to V 137).

Through the above-described means, separation of the fibers as a flocculent during the formation of the web is almost totally eliminated. As a result, the web produced is much more uniform than those formed on prior long wire apparatus. However, in practice, the improved effect is often not achieved. The inventor has recognized that during the formation of the web between two simultaneously co-rotating strips (normally wires), undesirable relative longitudinal motions occur between the liquid suspension being carried between the strip and the layers of fibrous material which have already been deposited on the strips. These motions cause a cloudy appearance in and the formation of nodular shapes in the web produced.

For this reason, the twin wire web forming apparatus has only been acceptable for producing a very limited range of types of paper and webs and only for high speed operation, or for producing the kind of products which do not need a high level of uniformity, as for example for the inner layers of multi-ply board.

SUMMARY OF THE INVENTION

The object of the invention is to remove the aforementioned failings and, through simple means, to eliminate the uncontrolled relative motions of parts of the suspension along the web formation zone between two strips that are rotating together.

The invention seeks to solve or reduce this problem by avoiding powerful pressure gradients which operate largely longitudinally along the dewatering or web formation zone because these pressure gradients would result in significant motion of the suspension relative to the strips either in the same direction as or else against the direction of the movement of the strips. The pressure gradients are avoided by arranging and/or forming the supporting devices for the outer or second strip, and thereby establishing the radius of curvature of the outer or second strip, so that at every point along the outer strip, the radius of that strip is approximately $$R\,[m] = \frac{S\left[\frac{N}{m}\right]}{p_o\,[Pa] + \rho\left[\frac{kg}{m^3}\right]\cdot g\left[\frac{m}{sec^2}\right]\cdot h\,[m]}$$

where S is the tension of the second strip; $p_o$ is the dynamic pressure of the suspension in the intake between the strips where the suspension first contacts both strips, said pressure being expressed in Pascal, or Newtons/square meter; $\rho$ is the density of the suspension; g is the acceleration due to gravity; h is the actual vertical height of or vertical distance between the point on the second strip at which the radius R is being measured and that particular point on the second strip at which the suspension in the dewatering area first contacts both strips. h is positive for those points on the second strip which lie downstream of the intake, and is negative for those points on the second strip which lie upstream of the intake.

The inner or first strip has the same curvature as and thus also may have its curvature expressed by the same formula.

Another way of expressing it is that the suspension is first brought between the first and second strips with a slight pressure $p_o$, and that the first strip is turned convexly to and over its first supporting device while the second strip is pressed pliably as a result of its longitudinal tension onto the surface of suspension, and the supporting devices are so arranged above and along the area of dewatering, that the outer strip in this area describes at least approximately an equipotential curve, i.e. it always exerts such a pressure on the suspension that geodesic differences in height in the curve of the web are counterbalanced through the altering radius of curvature of the outer strip to such an extent that no relative motion of the suspension occurs with respect to motion of the strips.

With this arrangement, the height of the layer of suspension in the drying area decreases, i.e. the curve of the web for the supporting elements reduces through subtraction of the local height of suspension from the curve of the outer strip. As the progress of dewatering of the suspension is determinable, the form of the supporting elements can be estimated with a high degree of accuracy.

The curve of the second or outer strip does not have to be constant. It can be approximated by means of a polygon-shaped arrangement of the supporting elements of the second strip.

According to a second design feature, the dewatering area is arranged in such a way that it slopes downwardly in the direction in which the strips are moving. Therefore, in the course of dewatering, a rise occurs in the pressure of dewatering, which is usually more advantageous than a decrease in pressure in this area.

According to another design feature, at least at the beginning of the formation of the web, the outer strip should lie above the inner strip. In this way, the great quantities of water which at the beginning of the dewatering process fall under the inner strip, flow away by force of gravity between the supporting elements that carry the first strip in the drainage area.

The area of web formation should begin approximately horizontal or sloping slightly downward and then continue in the direction of co-rotation of the strips with a progressive downward curvature.

Regardless of whether the drainage or dewatering area starts more horizontal and then curves down, or starts more vertical and curves horizontally, in general, the alteration in the direction of ths strips in the drainage area will lie between 30° and 120°.

A further design feature envisages that the water pressure of the fiber suspension at the beginning of the drainage area, i.e. at the intake between the two strips where the suspension first contacts both strips between the strips should be only slight and should come to 1,000 Pa, at the most. This pressure of accumulation of water is produced because the flow of material at the intake between the strips is somewhat retarded. Therefore, the kinetic energy of the suspension flow is transformed into pressure.

Using the curved surface of a suction box to serve as the support of the second strip in the drainage area is useful. The vacuum holds the concave curvature of the outer strip. Further, with the help of the vacuum created, the drainage process can be increased.

In another design, it is envisaged to produce the tension of the outer strip by means of a movable hitch-roll, whereby at least half, and preferably the whole tension is produced by the effect of the force of gravity on the hitch-roll itself and/or by additional weights striking at the latter roll directly or above levers, etc. In this way, the tension can be kept more exactly constant than with pneumatic or hydraulic means. Through this method it is possible to match the tension very exactly to the value of the construction and thereby be sure to keep the shifting movements of the suspension towards the strips during the formation of the web sufficiently small. For adjustment of the exact tension required, independent of the weights, small pneumatic or hydraulic supplementary cylinders which affect the hitch roll can be used.

Other objects and features of the invention will be appreciated from the specific embodiments of the invention which are now described, with reference to the accompanying drawings.

DESCRIPTION OF THE PREFERRED EMBODIMENTS

Figure 1:
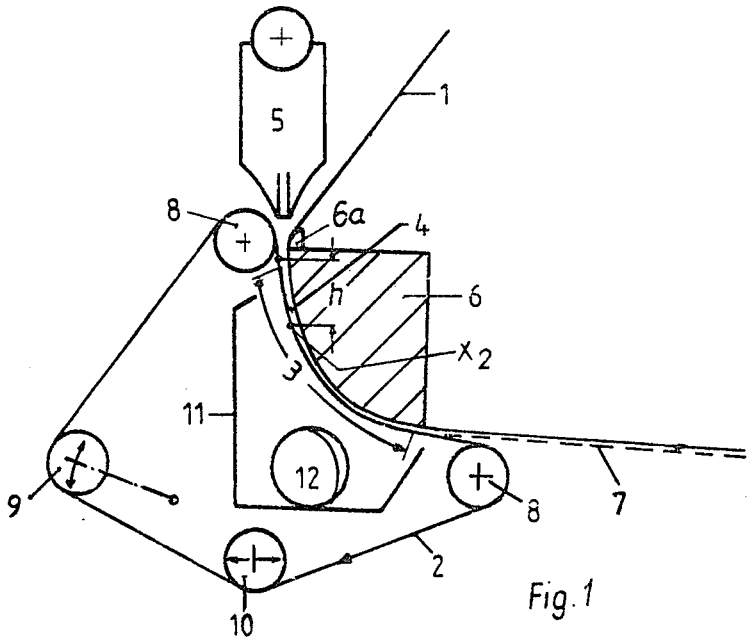
FIGS. 1 to 3 are longitudinal sections through embodiments of web forming units according to the invention, with outer strips thereof having an equipotential curvature.

Referring to FIG. 1, there is shown a first or inner endless rotating strip 1 whose pathway and support in the drainage area is illustrated. There is also shown a second or outer endless rotating strip 2. Both strips move together and pass through a curved area of web formation or drainage area 3, and the layer of suspension, which has to be drained, is guided between them. The suspension is sprayed between the moving strips by the headbox 5.

Inner strip 1 is supported by a stationary part 6 over which the strip slides. The part 6 has a convexly curved inflow-ridge 6*a*, over which the strip 1 moves down into the drainage area 3. In this embodiment, the pathway of the strips in the drainage area curves from being more vertical to being more horizontal. After leaving the drainage area 3, the dried web 7 follows the strip 1.

Outer strip 2 is guided down over the guide-rolls 8, hitch-roll 9 and regulating roll 10. Hitch-roll 9 comprises a weighted roll supported rotatably at the end of a pivotable arm and adapted to pivot up and down for maintaining constant tension on strip 2. Strip 2 is permeable, and formed, for example, as a wire. The water which passes through the strip 2 in the drainage area 3 is caught in the tank 11 and is led out through an outlet 12 laterally of the strip 2. At least one of the strips is driven in the direction of the directional arrows by motor driven rolls.

The height or distance between the intake of the drainage zone and a point $x_2$, at which the radius of the second or outer strip 2 is here being determined, is indicated by the letter "h".

The radius of curvature of the second or outer strip 2 at point $x_2$ is calculated according to the formula set forth above.

The first or inner strip 1 is curved correspondingly to the second strip and its curvature substantially follows the same formula.

Figure 2:
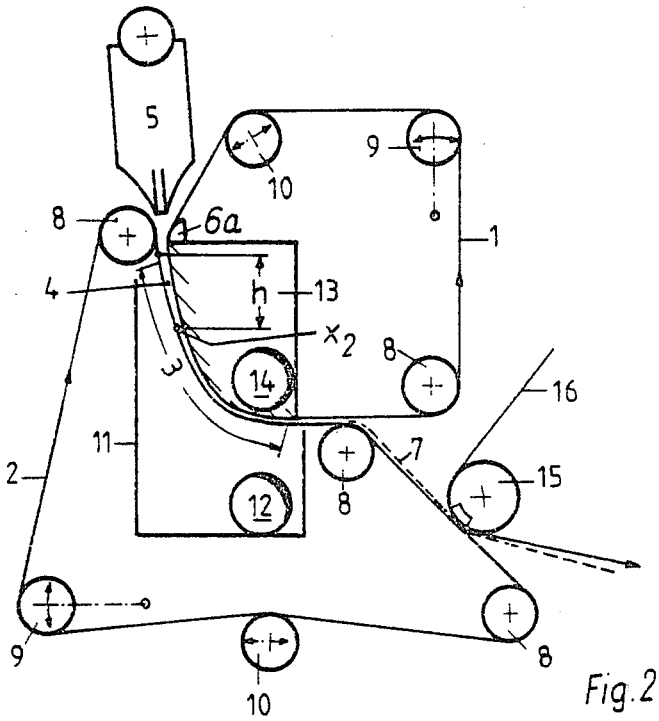

FIG. 2 represents a similar web forming unit, wherein parts analogous to those in FIG. 1 are identified by the same numbers and perform the same function. Inner strip 1 is here likewise a sieve, which is also supported by a suction box 13 with a lateral outlet 14. Web 7 here follows strip 2 as far as a suction roll 15, which then sucks the web on to a receiving felt strip, i.e. felt 16. The above comments as to the curvature of the outer and inner strips 2 and 1, respectively, apply here too.

Figure 3:
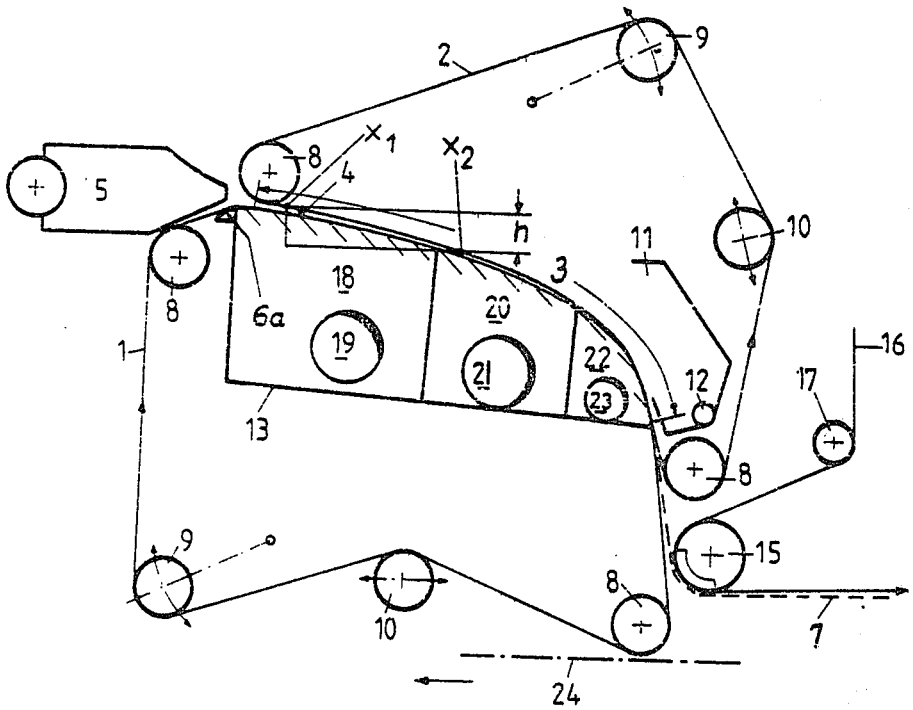

In the embodiment of FIG. 3, the same reference numbers as in FIGS. 1 and 2 are used for the corresponding parts. In this embodiment, the pathway of the strips starts more horizontal and curves vertically downwardly.

In the embodiment of FIG. 3, the headbox 5 spouts the suspension 4 between the strips or wires 1 and 2, which are guided over the respective guide-rolls 8, 9, 10, and which are supported in the drainage area 3 by the curvative of the surface of the suction box 13. The water that has passed through strip 2 is extruded or drawn off into the collection tank 11 and it leaves this laterally through the outlet channel 12. On separation of the strips, the web 7 follows strip 1 and is drawn by means of the suction-roll 15 on to the felt 16 which is guided over a guide roll 17.

The suction box 13 is subdivided into three suction zones 18, 20, 22 with respective lateral water outlets 19, 21, 23.

As an alternative to being collected on a felt 16, the web can also be deposited from the strip 1 on to a strip or conveyor 24, illustrated with a dotted line, which is moving in the direction of the strip 1.

Pressure $p_o$ at the beginning $x_1$ of the intake should preferably lie between 50 Pa and 1000 Pa.

Figure 4:
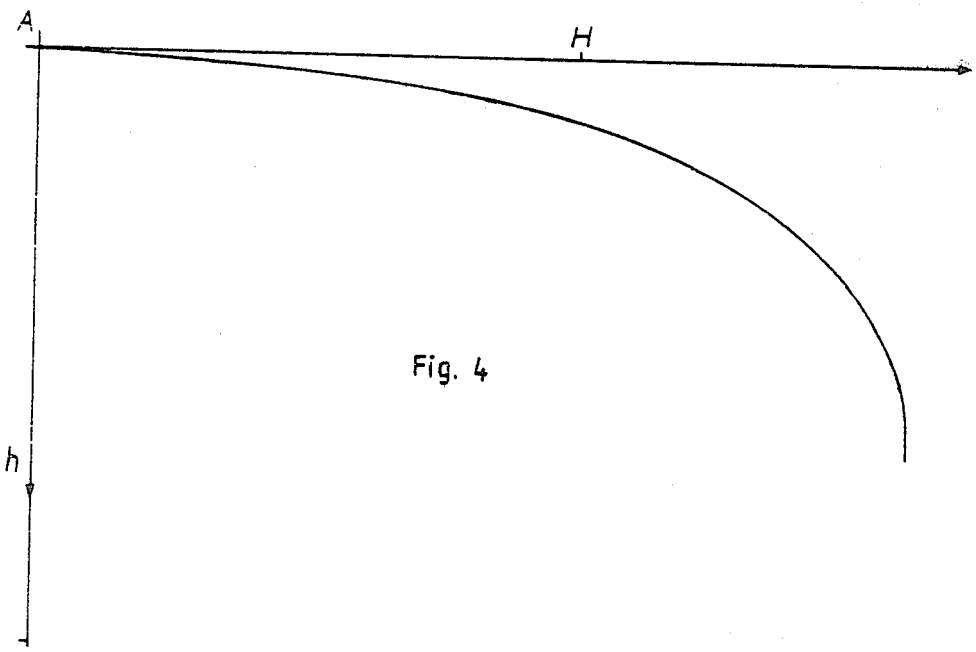
FIG. 4 is an example of such an equipotential curve of the web for the outer strip.

FIG. 4 shows an equipotential curve in the strip, which was calculated according to the method of finite steps on a computer for the following limiting conditions.

Pressure $p_o$ at the starting point $x_1=A$, which is approximately 100 Pa; the angle $\alpha$ between a horizontal plane H and a tangent at $x_1=2°$; and the longitudinal tension of the strip=2 N/mm. The curve is drawn to the scale 1:10. Compare FIG. 5.

Figure 5:
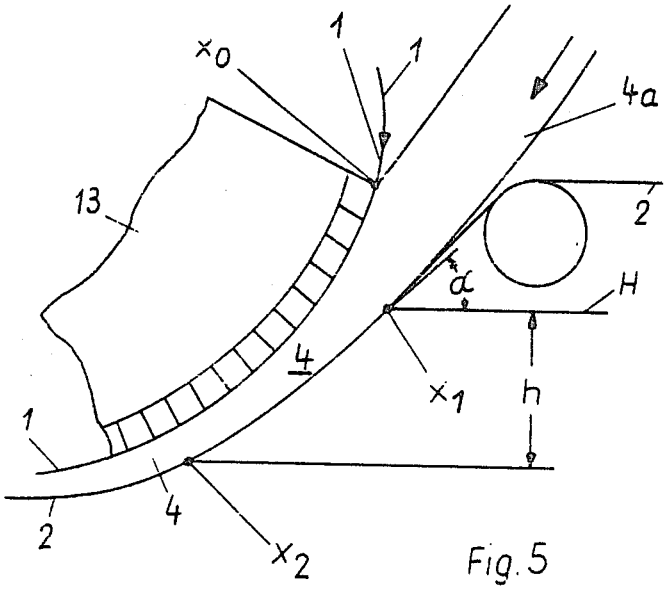
FIG. 5 is a fragment of an additional apparatus in accordance with the invention.

FIG. 5 shows an example, whereby the suspension stream 4a first strikes against the inner strip 1, which is a sieve. There at $x_o$, the drainage process begins. The suspension stream 4a touches the outer strip 2 at $x_1$. This has been referred to herein as the intake, where the suspension contacts both strips for the first time. The point at the outer strip 2 where the radius of curvature is to be defined is marked $x_2$. The vertical distance between $x_1$ and $x_2$ is the height h.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. Apparatus for dewatering a suspension of fibers comprising:

a first strip movable through a dewatering region; first support means for moving said first strip on a convex pathway through the dewatering region and for maintaining longitudinal tension of said first strip; said first support means comprising a stationary support which is convexly curved and over and with respect to which said first strip is moved; said first support means including means for moving said first strip over said stationary support;

a second strip movable together with said first strip through the dewatering region; second support means for moving said second strip along a concave pathway through the dewatering region and for moving said second strip spaced from said first strip and for also maintaining the longitudinal tension of said second strip;

at least one said strip being water permeable;

for eliminating pressure gradients in the suspension held between said strips passing through the dewatering region, said second support means being shaped for maintaining the radius of curvature of said second strip at a value at which the radius of curvature at every point along said second strip substantially is:

$$R\,[m] = \frac{S\left[\frac{N}{m}\right]}{p_o\,[Pa] + \rho\left[\frac{kg}{m^3}\right]\cdot g\left[\frac{m}{\sec^2}\right]\cdot h\,[m]}$$

where S is the tension of said second strip established by said second support means therefor; $p_o$ is the dynamic pressure of the suspension in the intake between said strips where the suspension first contacts both said strips; $\rho$ is the density of the suspension; g is the acceleration due to gravity; h is the actual vertical height or distance between the point on said second strip at which the radius is being measured and the point on said second strip at which the suspension first contacts both said strips.

2. The apparatus of claim 1, wherein at least in the vicinity of where the suspension first contacts both said strips, said second strip is above said first strip.

3. The apparatus of claim 2, wherein in the vicinity where the suspension first contacts both said strips said first and said second support means are shaped and positioned such that the dewatering region is approximately horizontal.

4. The apparatus of claim 1, wherein in the vicinity where the suspension first contacts both said strips, said first and said second support means are shaped and positioned such that the dewatering region is approximately horizontal.

5. The apparatus of claim 1, wherein the dewatering region is so shaped and said first and said second support means are so shaped and positioned that the dewatering region is generally more vertical where the suspension first contacts both said strips, of said first and said second strips and the dewatering region is curved to slope toward the horizontal beyond the vicinity where the suspension first contacts both said strips.

6. The apparatus of claim 1, wherein the pressure of the suspension at the vicinity where the suspension first contacts both said strips is about 1000 Pa at most.

7. The apparatus of claim 1 wherein said first stationary supporting means comprises a suction box having a surface over which said first strips passes, and said surface being convexly curved; said first strip being water permeable for enabling said suction box to dewater suspension passing over said first strip.

8. The apparatus of claim 1, further comprising means for maintaining the longitudinal tension of said second strip.

9. The apparatus of claim 8, wherein said means comprises a hitch-roll about which said second strip passes and said hitch-roll being supported in said apparatus for shifting under the influence of gravity to increase the tension of said second strip.

10. The apparatus of claim 1, wherein said first strip has a curvature that follows substantially the curvature of said second strip.

* * * * *